US005962827A

United States Patent [19]

Zdanys, Jr.

[11] Patent Number: 5,962,827

[45] Date of Patent: Oct. 5, 1999

[54] SEALED DIP SWITCH

[75] Inventor: John Zdanys, Jr., Elkhart, Ind.

[73] Assignee: CTS Corporation, Elkhart, Ind.

[21] Appl. No.: 09/190,915

[22] Filed: Nov. 12, 1998

[51] Int. Cl.[6] ..... H01H 15/00

[52] U.S. Cl. ..... 200/302.1; 200/517; 200/551; 200/16 R

[58] Field of Search ..... 200/16 R–16 D, 200/18, 512, 517, 511, 547–551, 302.1, 5 R

[56] References Cited

U.S. PATENT DOCUMENTS

| | | | |
|---|---|---|---|
| 3,555,213 | 1/1971 | Cherry | 200/17 R |
| 3,806,685 | 4/1974 | Seeger, Jr. et al. | 200/153 L |
| 4,114,000 | 9/1978 | Feder | 200/16 R |
| 4,268,728 | 5/1981 | Rose | 200/16 R |
| 4,322,588 | 3/1982 | Chumley et al. | 200/5 A |
| 4,324,956 | 4/1982 | Sakakino et al. | 200/16 R |
| 4,324,958 | 4/1982 | Valleau | 200/16 F |
| 4,389,549 | 6/1983 | Brown | 200/5 R |
| 4,529,851 | 7/1985 | Priebe et al. | 200/16 D |
| 4,841,109 | 6/1989 | Sasakino et al. | 200/302.1 |
| 4,851,625 | 7/1989 | Liebich | 200/511 |
| 4,918,264 | 4/1990 | Yamamoto et al. | 200/5 R |
| 5,147,990 | 9/1992 | Dionisio, Jr. et al. | 200/16 R |

FOREIGN PATENT DOCUMENTS

| | | | |
|---|---|---|---|
| 0 003 434 A1 | 8/1979 | European Pat. Off. | H01H 15/02 |

*Primary Examiner*—Michael Friedhofer
*Attorney, Agent, or Firm*—Michael W. Starkweather; Mark Bourgeois

[57] ABSTRACT

A dual in line switch apparatus selects between several switch positions. A housing has several slides. A row of terminals is attached to the housing. A contact sheet is located between the slides and the terminals. The contact sheet operates, as the slide is moved, to make and break electrical connections between the terminals. The contact sheet includes a flexible film having a contact pad and a detent notch and an adhesive tape that is attached to the flexible film. The tape has a slot formed therein and the contact pad is pressed through the slot by the slide to electrically connect with the terminals. The switch provides electrical contacts that are sealed from detrimental environmental effects. The detent notch provides a positive mechanical stop with tactile feedback for each of the switch positions. An alternative embodiment uses another flexible film with conductive vias that connect to solder spheres.

11 Claims, 6 Drawing Sheets

SEALED DIP SWITCH

BACKGROUND OF THE PREFERRED EMBODIMENT(S)

1. Field of the Preferred Embodiment(s)

This invention generally relates to a sealed dual in line package (DIP) switch used on printed circuit boards for selecting between several switch positions in harsh environments. Specifically, there is a housing that contains a slide, membrane contacts, terminals and a detent. As the slide is moved linearly, the membrane contacts make and break electrical connections.

2. Description of the Related Art

Various devices are well known for selecting between several switch positions such as rotary switches, encoders, push button switches, linearly actuated switches, and prior art DIP switches.

Some applications of DIP switches are desired to be used under harsh environmental conditions. Examples of these conditions are environments of high humidity, and temperature swings such as might be encountered in the tropics or in marine environments. Another example of a harsh environment is in factories. In a factory, DIP switches can be exposed to high levels of dust and vibration. It is desired that a DIP switch exposed to harsh environments function reliably without failure. It is also desired that the DIP switch have a low cost and is easy to manufacture.

Despite the prior art devices, none have functioned well in a harsh environment and been easily manufacturable with a low part count at a low cost. A current unmet need exists for a sealed DIP switch that has a low part count that is easily assembled at a low cost and is sealed to function in harsh environments.

3. Description of Related Art

Examples of patents related to the present invention are as follows, wherein each patent is herein incorporated by reference for related and supporting teachings:

U.S. Pat. No. 4,268,728, is a switch encoder.

U.S. Pat. No. 4,324,958, is a tactile switch device.

U.S. Pat. No. 3,555,213, is a cross bar slide selector switch.

U.S. Pat. No. 4,389,549, is a side actuated miniature dip switch.

U.S. Pat. No. 4,529,851 is a machine insertable miniature dip switch.

European patent no. 0 003 434 A1 is an electrical switch.

U.S. Pat. No. 3,806,685, is a switch with guide means and conductive sheet contact.

U.S. Pat. No. 4,114,000, is a switch with a sliding actuator cam.

The foregoing patents reflect the state of the art of which the applicant is aware and are tendered with the view toward discharging applicants' acknowledged duty of candor in disclosing information that may be pertinent in the examination of this application. It is respectfully stipulated, however, that none of these patents teach or render obvious, singly or when considered in combination, applicants' claimed invention.

SUMMARY OF THE PREFERRED EMBODIMENT(S)

It is a feature of the invention to provide a sealed dual in line switch apparatus for selecting a plurality of switch positions, including a housing and a slide located within the housing. A row of terminals is attached to the housing. A contact sheet is located between the slide and the terminals. The contact sheet operates, as the slide is moved, to make and break electrical connections between the terminals in a manner sealed to the external environmental conditions. The contact sheet includes a flexible film having a contact pad and a detent notch and an adhesive tape that is attached to the flexible film. The tape has a slot formed therein and the contact pad is pressed through the slot by the slide to electrically connect the terminals. The detent notch provides a positive mechanical stop with tactile feedback for each of the switch positions.

A further feature of the invention is to provide a dual in line switch apparatus for selecting a plurality of switch positions, including a housing and a slide disposed within the housing. A terminator is attached to the housing and connects to an external electrical device. A contactor is located between the slide and the terminator means, for making and breaking electrical connections between the terminator means as the slide is moved. The contact means includes a flexible film having a contact pad and a detent notch. An adhesive tape is attached to the flexible film and has a slot formed therein. The contact pad operates to be pressed through the slot by the slide to make and break electrical connections. A detent is attached to the contactor, for providing a positive mechanical stop for the switch positions.

It is a feature of the invention to provide the contactor with a first flexible film having a contact pad and a detent notch. A second flexible film has a plurality of conductor lines and conductive vias. An adhesive tape is located between the first and second flexible films, and has a slot formed therein. The contact pad operates to be pressed through the slot by the slide to make and break electrical connections between the conductor lines.

Yet another feature of the invention is to provide a sealed dual in line switch apparatus for selecting a plurality of switch positions, including a housing and a slide disposed within the housing. A row of terminals is attached to the housing. A flexible film is located between the terminals and the slide. The film has a contact pad and a detent notch. An adhesive tape is attached to the flexible film and has a slot formed therein. The contact pad is pressed through the slot by the slide to electrically connect the terminals.

Another feature of the invention is to provide a sealed dual in line switch apparatus for selecting a plurality of switch positions that has a housing and a slide disposed within the housing. A row of terminals is attached to the housing. A first flexible film has a contact pad and a detent notch. A second flexible film has a plurality of conductor lines and conductive vias. An adhesive tape is located between the first and second flexible films and has a slot formed therein. The contact pad operates to be pressed through the slot by the slide to make and break electrical connections between the conductor lines.

The invention resides not in any one of these features per se, but rather in the particular combination of all of them herein disclosed and claimed. Those skilled in the art will appreciate that the conception, upon which this disclosure is based, may readily be utilized as a basis for the designing of other structures, methods and systems for carrying out the several purposes of the present invention. Further, the abstract is neither intended to define the invention of the application, which is measured by the claims, neither is it intended to be limiting as to the scope of the invention in any way.

BRIEF DESCRIPTION OF THE DRAWINGS

These and other features of the invention can best be understood by the following description of the accompanying drawings as follows.

It is noted that the drawings of the invention are not to scale. The drawings are merely schematic representations, not intended to portray specific parameters of the invention. The drawings are intended to depict only typical embodiments of the invention, and therefore should not be considered as limiting the scope of the invention. The invention will be described with additional specificity and detail through the accompanying drawings.

DETAILED DESCRIPTION OF THE PREFERRED EMBODIMENT

Figure 1:
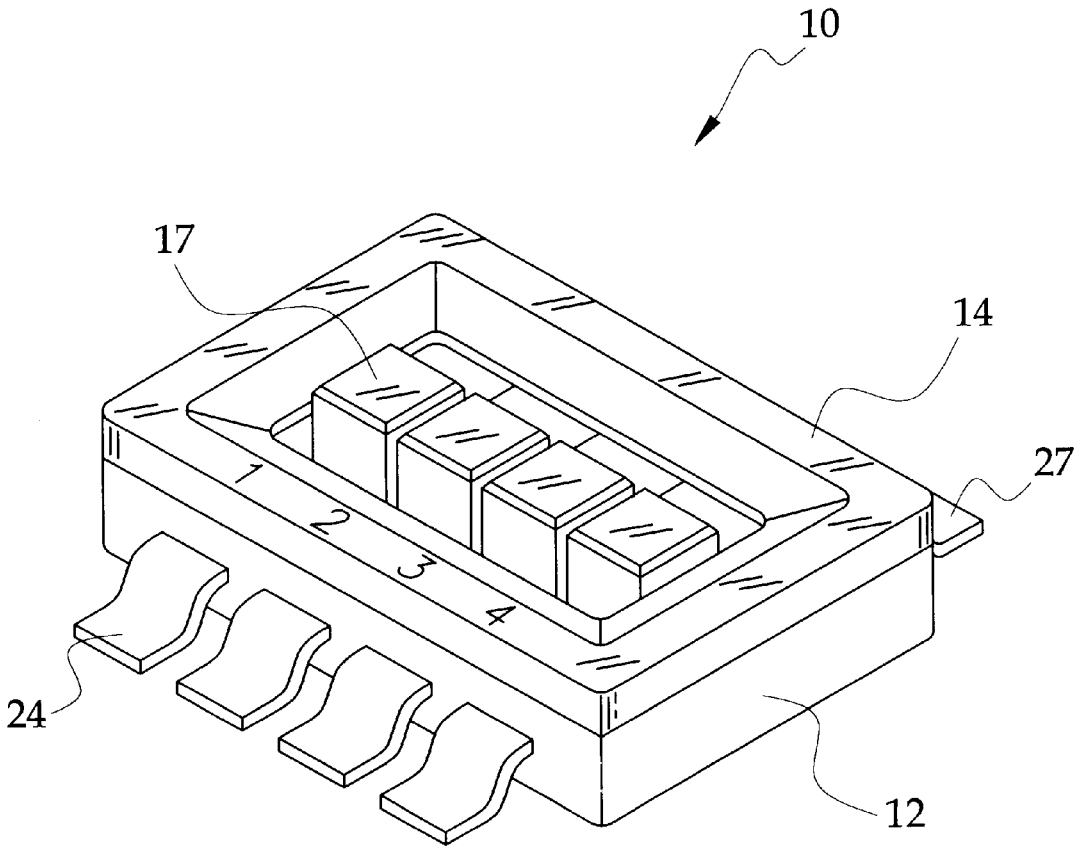
FIG. 1 is a perspective view of the preferred embodiment of a sealed DIP switch.
Figure 2:
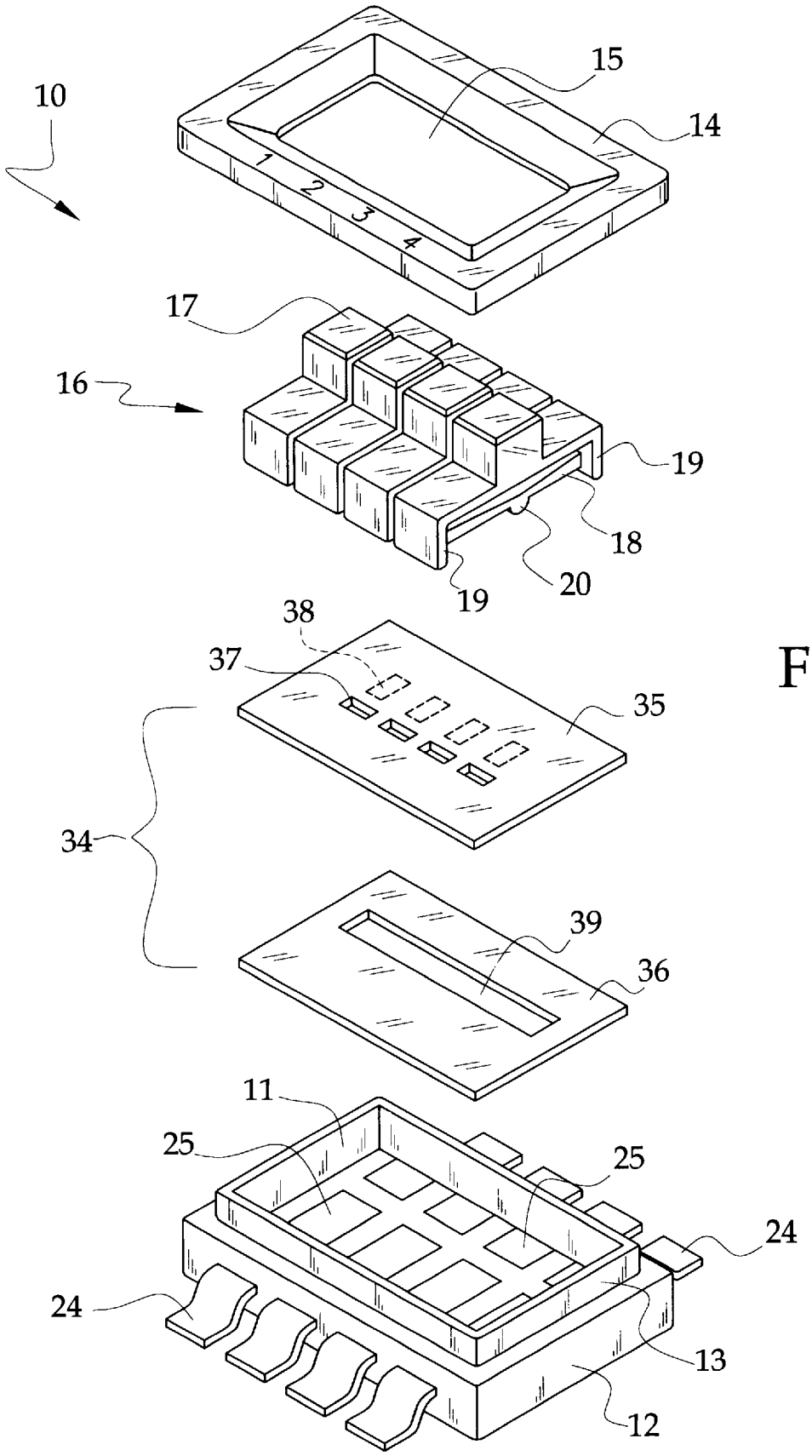
FIG. 2 is an exploded perspective view of FIG. 1.
Figure 3:
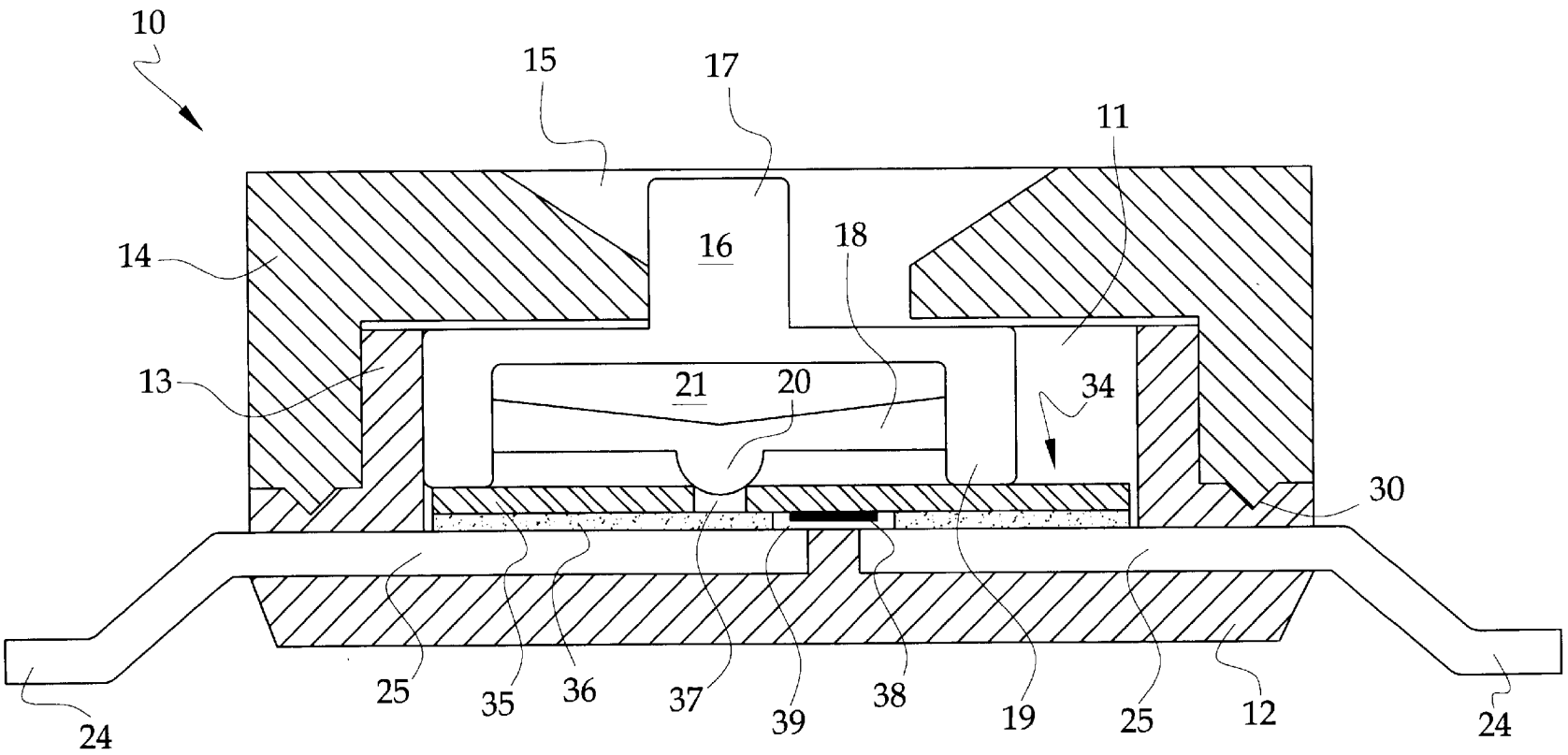
FIG. 3 is a side cross-sectional view of FIG. 1 taken between one of the slides.

Referring to FIGS. 1, 2 and 3 there is shown a DIP switch assembly 10. Specifically, there is a generally rectangular housing 12 with a cavity 11 therein and an upright wall 13. A cover 14 is designed to fit over wall 13 and abut against housing 12 and includes a cover aperture 15. Cover 14 may be joined to housing 12 by an ultrasonic weld 30. A T-shaped slide 16 has a slide grip 17 formed on the top, a pressure spring 18 is formed between slide supports 19. A detent or bump 20 extends downwardly from spring 18. An air gap 21 is located in slide 16. A rectangular contact sheet or layer 34 is located at the bottom of cavity 11. Sheet 34 has a flexible film 35 and an adhesive tape 36. Flexible film 35 has a detent notch 37 and a contact pad 38 that is located on the bottom of film 35. The flexible film may be formed of mylar or kapton, for example. Pad 38 may be made of a conductive material such as copper. A slot 39 is formed in adhesive tape 36. Adhesive tape 36 bonds to film 35 when tape 36 and film 35 are pressed together. Housing 12, cover 14 and slide 16 are preferably molded out of plastic. Insert molded into housing 12 are terminals 25. Terminals 25 have a terminal leg 24 that is to downwardly bent and extends outside of and away from housing 12. Terminal legs 24 are typically soldered to a printed circuit board (not shown) to provide electrical connections between external circuits on the printed circuit board and the DIP switch. Terminals 25 may be formed from a rectangular strip of an alloy of copper.

Figure 4:
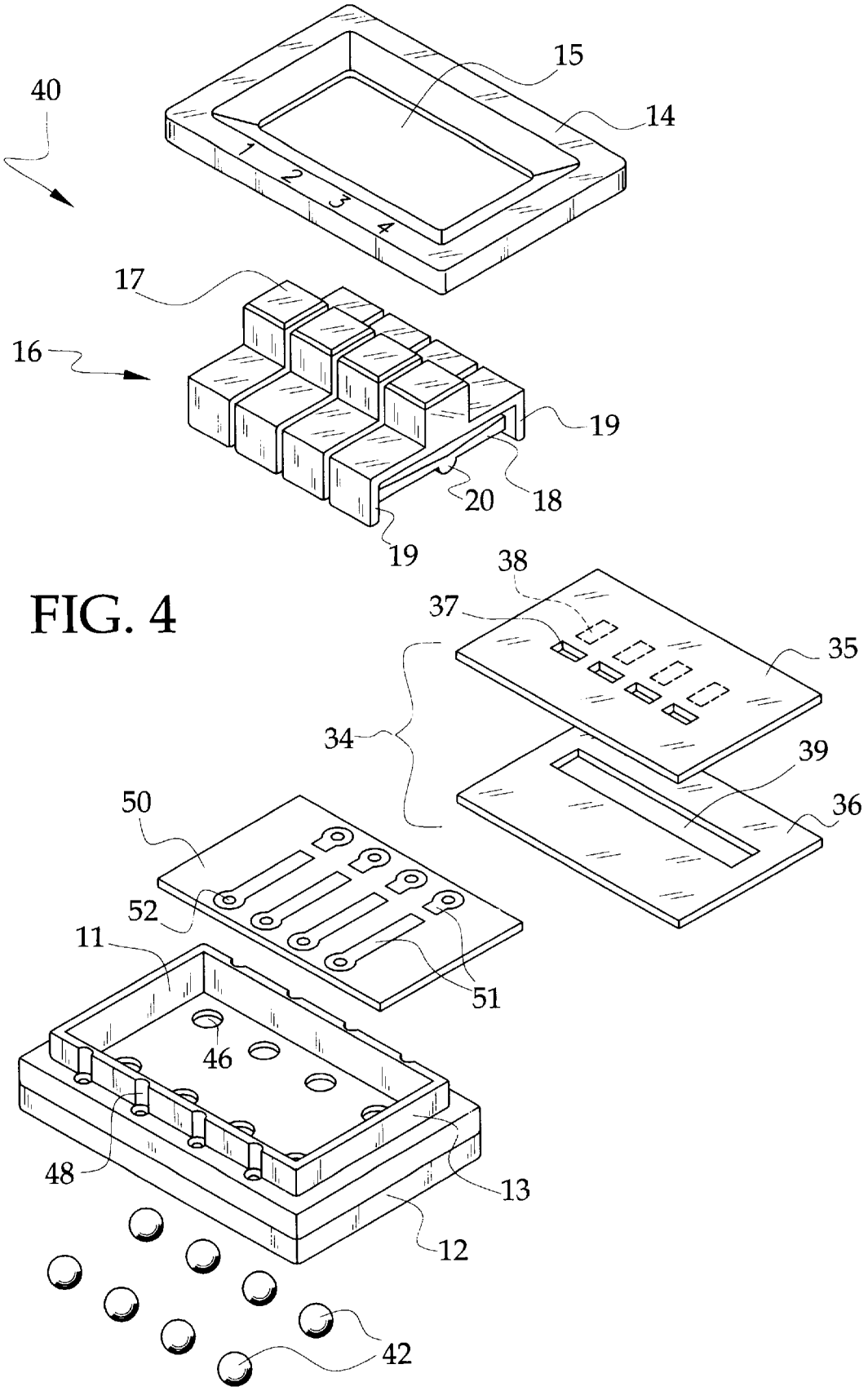
FIG. 4 is an exploded perspective view of an alternative embodiment of a sealed DIP switch using solder sphere terminations.
Figure 5:
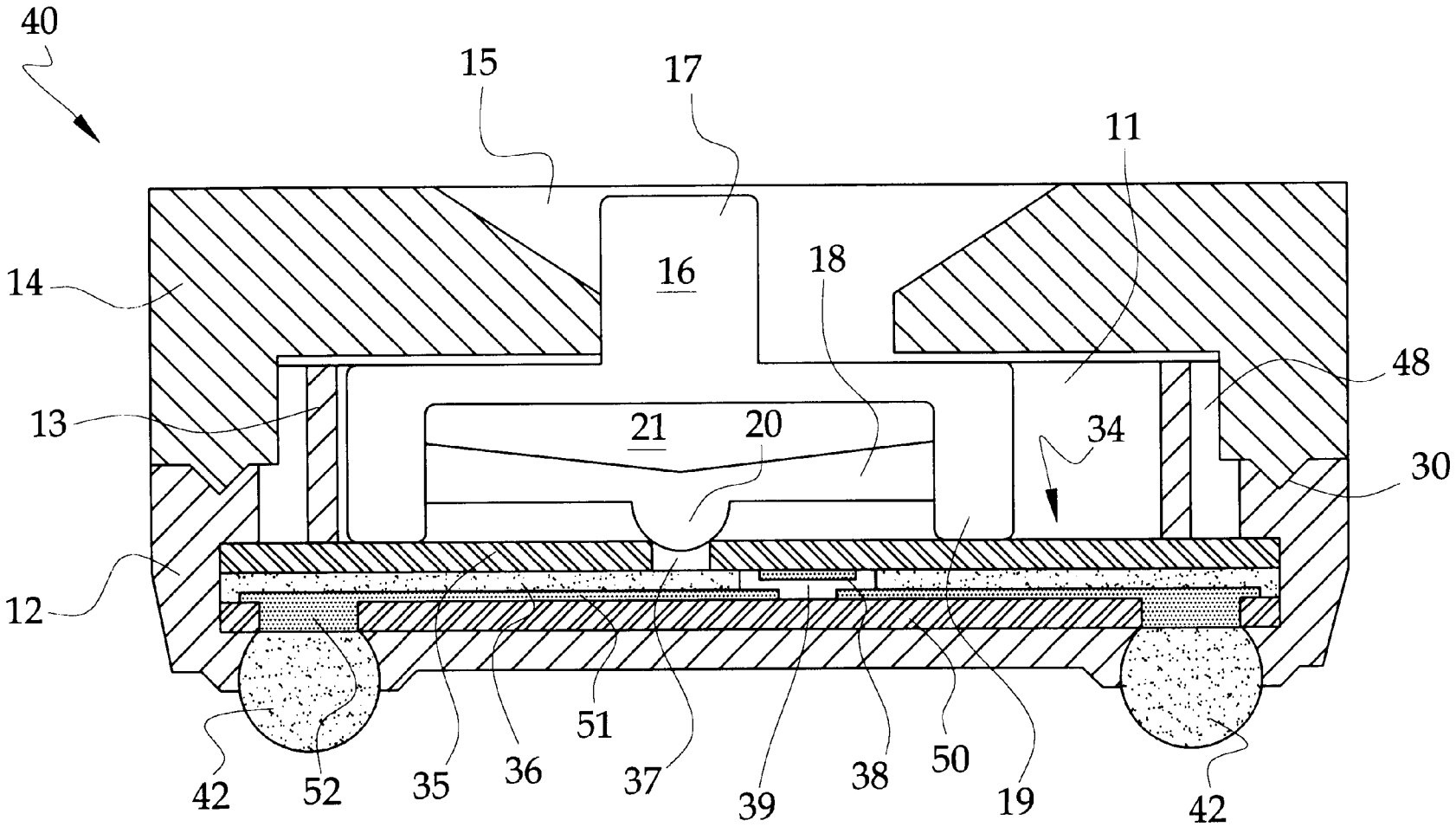
FIG. 5 is a side cross-sectional view of an assembled FIG. 4 taken between one of the slides.

Referring to FIGS. 4, and 5 there is shown an alternative embodiment of a sealed DIP switch 40 using solder sphere terminations. In addition to the previous preferred embodiment, shown in FIGS. 1, 2 and 3, there are the following elements: Specifically, there are holes 46, and slots 48 formed in housing 12. A lower flexible film 50 is positioned under flexible film 35 and has conductor lines 51 arranged on the top surface. Conductor lines 51 connect with conductive vias 52 that connect from the top surface to the bottom surface of film 50. Adhesive tape 36 bonds to films 35 and 50 when tape 36 is sandwiched between films 35 and 50. Housing 42, cover 14 and slide 16 are preferably molded out of plastic. Contact sheet 34 and film 50 are insert molded into housing 12. Slots 48 allow for release pins (not shown) to be used during the molding process. Solder spheres or balls 42 are partially located within holes 46 and are electrically connected to vias 52 by a reflowed solder paste (not shown). Solder spheres 42 would be further connected to a printed circuit board (not shown).

Figure 6:
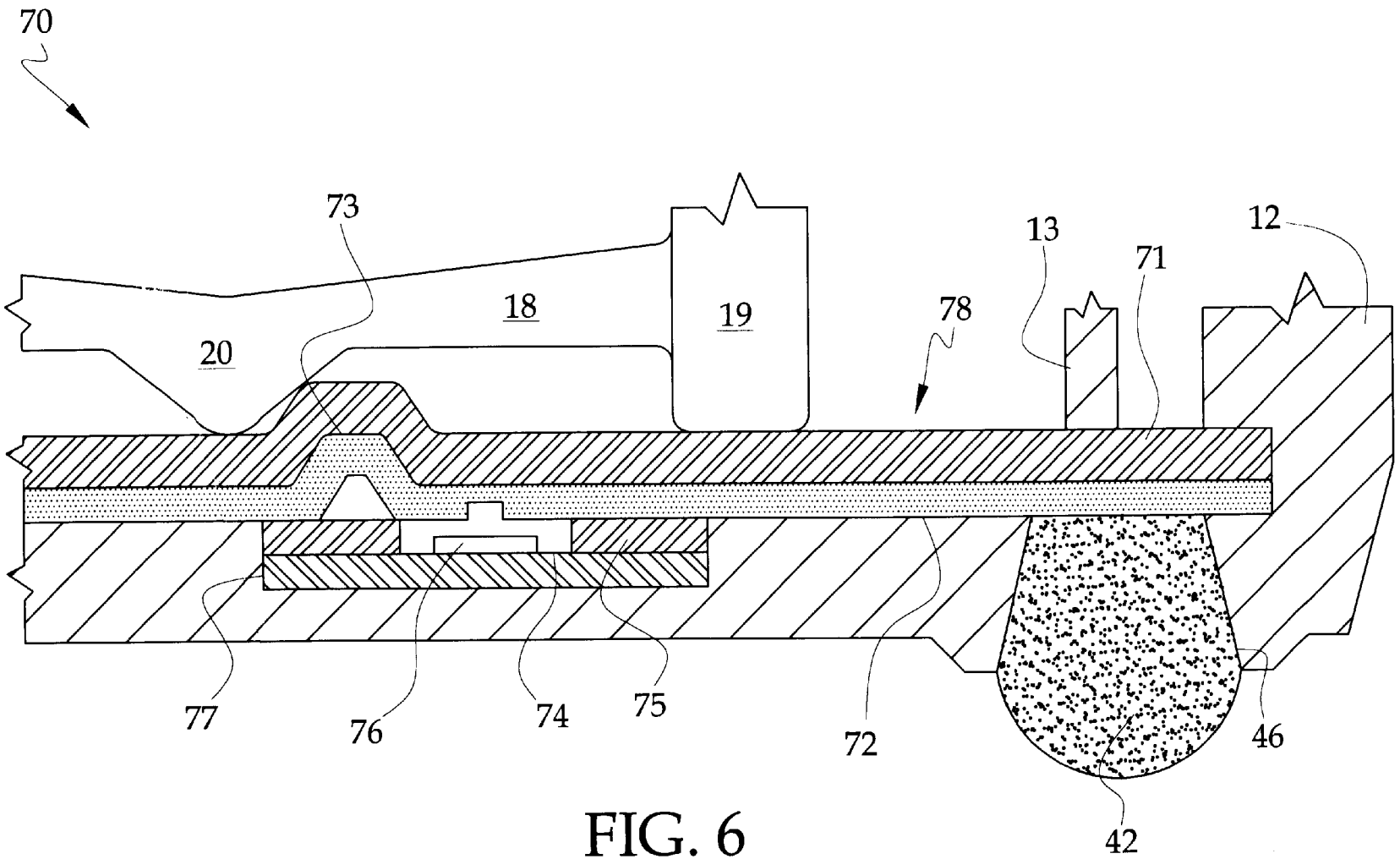
FIG. 6 is an enlarged partial cross-sectional view of another embodiment using a solder sphere termination.

Referring to FIG. 6, a partial cross-sectional view of another embodiment using a solder sphere termination is shown. In addition to the previous embodiment, shown in FIGS. 4 and 5, there are the following elements: Specifically, A contact sheet 78 is located in cavity 11. Sheet 78 has a top flexible film 71 that has several conductor lines 72 formed thereon. Flexible film 71 has a detent bump 73 formed therein. The flexible film is formed of mylar or kapton, for example. A lower flexible film 74 has contact pad 76 arranged on the top surface. Film 74 is located in recess 77 in housing 12. Adhesive tape 75 bonds flexible films 71 and 74 together. Housing 12, cover 14 and slide 16 are preferably molded out of plastic. Contact sheet 78 is insert molded into housing 12. Slots 48 allow for release pins (not shown) to be used during the molding process. Solder spheres or balls 42 are partially located within holes 46 and are electrically connected to lines 72 by a reflowed solder paste (not shown). Solder spheres 42 would be further connected to a printed circuit board (not shown).

DIP switch assembly 10 is assembled as follows: The first step is to insert mold terminals 25 into housing 12. The second step is to laminate film 35 to adhesive tape 36 and place it in cavity 11. The third step is to place the slides 16 on top of film 35. The fourth step is to place cover 14 over housing 12 and to connect them with an ultrasonic weld 30.

DIP switch assembly 40 is assembled as follows: The first step is to laminate films 35 and 50 to adhesive tape 36 to form contact sheet 34. The second step is to mold housing 12 over contact sheet 34. The third step is to place the slides 16 on top of sheet 34. The fourth step is to place cover 14 over housing 12 and to connect them with an ultrasonic weld 30. The fifth step is to place solder paste into holes 46 and then to place the solder balls 42 into holes 46. The sixth step is to reflow the solder paste by placing assembly 40 in a reflow oven and heating.

DIP switch assembly 70 is assembled as follows: The first step is to laminate films 71 and 74 using adhesive tape 75 to form contact sheet 78. The second step is to mold housing 12 over contact sheet 78. The third step is to place the slides 16 on top of sheet 78. The fourth step is to place cover 14 over housing 12 and to connect them with an ultrasonic weld 30. The fifth step is to place solder paste into holes 46 and then to place the solder balls 42 into holes 46. The sixth step is to reflow the solder paste by placing assembly 70 in a reflow oven and heating.

During operation of DIP switch 10, slide grip 17 is grasped by the user and moved. As slide grip 17 moves, slide 16 and bump 20 move. When bump 20 is initially engaged with detent notch 37, the switch is in the off position and there is no electrical connection between terminals 24. As slide 16 is moved, bump 20 flexes via spring 18 and slides over flexible film 35 and forces contact pad 38 down into slot 39 and into contact with terminals 24. In this position, contact pad 38 completes an electrical connection between terminals 24 and the switch is in the on position.

Operation of DIP switch 40 is similar to DIP switch 10, slide grip 17 is grasped by the user and moved. As slide grip 17 moves, slide 16 and bump 20 move. When bump 20 is initially engaged with detent notch 37, the switch is in the off position and there is no electrical connection between spheres 42. As slide 16 is moved, bump 20 and spring 18 flex and slide over flexible film 35 and forces contact pad 38 down into slot 39 and into contact with conductor lines 51. In this position, contact pad 38 completes an electrical connection between spheres 42 and the switch is in the on position.

Operation of DIP switch 70 is similar to DIP switch 40, slide grip 17 is grasped by the user and moved. As slide grip 17 moves, slide 16 and bump 20 move. When bump 20 is initially engaged with detent bump 73, the switch is in the off position and there is no electrical connection between spheres 42. As slide 16 is moved, bump 20 and spring 18 flex and slide over bump 73 and top flexible film 71 and forces conductor lines 72 down into contact with contact pad 76. In this position, contact pad 76 completes an electrical connection between spheres 42 and the switch is in the on position.

Remarks About the Preferred Embodiment

One of ordinary skill in the arts of switches, and more particularly the art of designing DIP switches, will realize many advantages from using the preferred embodiment. In particular, the DIP switch provides the user with a switch that is sealed against harsh environmental conditions. The use of contact pad 38 sealed between flexible film 35 and housing 12 prevents contamination of the electrical contacts and allows the switch to function under adverse conditions.

Additionally, a skilled artisan will understand that the DIP switch can be fabricated in a small size and has a small footprint when it is mounted on a printed circuit board. Specifically, the use of contact sheet 34 allows for a very narrow slide. The space saving is more noticeable when several slides are stacked side by side and results in the overall size of the DIP switch being small. Also, DIP switch 10 does not have spacers or guides between the slides as is shown in the prior art. The omission of the spacers contributes to achieving a narrower design and a fine pitch. It is further noted that a skilled artisan would realize that the DIP switch 10 is capable of being economically manufactured. Specifically, the use of contact sheet 34 is very cost effective and results in an easily assembled switch.

Variations of the Preferred Embodiment(s)

One of ordinary skill in the art of making switches will realize that there are many different ways of accomplishing the preferred embodiment. For example, it is contemplated to make the housing 12, cover 14, and slide 16 out of any suitable material, like plastics, epoxy resin, or fiberglass. Additionally, the cover could be fastened to the housing by other methods such as glue or screws, or mechanical fasteners.

Even though, the embodiment discusses the use of two terminals 25. It is contemplated to use three or four or more terminals in a row to provide multiple switch positions. Two or more detent positions could be used with the multiple switch positions for each slide.

Although, switch 10 is illustrated as having a detent notch 37. It is contemplated to omit notch 37 and provide no mechanical feedback to the user.

Additionally, although it is illustrated that vias 52 are used to connect solder spheres 42, it is contemplated to use other types of connections such as pins.

Although, switch 10 is illustrated as having a detent notch 37. It is contemplated to omit notch 37 and provide no mechanical feedback to the user.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What I claim and desire to be secured by Letters Patent is:

1. A dual in line switch apparatus for selecting a plurality of switch positions, comprising:

a) a housing;

b) a slide, disposed within the housing, for sliding within the housing;

c) a plurality of terminals attached to the housing; and d) a contact sheet, disposed between the slide and the terminals, for making and breaking electrical connections between the terminals as the slide is moved over the contact sheet, the contact sheet including: 1) a flexible film having a contact pad and a detent notch; and 2) an adhesive tape, attached to the flexible film, and having a slot formed therein, the contact pad operable to be pressed through the slot by the slide to electrically connect the terminals.

2. The apparatus according to claim 1, wherein the detent notch provides a positive mechanical stop with tactile feedback for each of the switch positions.

3. The apparatus according to claim 2, wherein the slide is retained within the housing by a cover.

4. The apparatus according to claim 3, wherein the terminals have a leg portion for connecting to an external electrical device.

5. A dual in line switch apparatus for selecting a plurality of switch positions, comprising:

a) a housing;

b) a slide disposed within the housing;

c) termination means, attached to the housing, for connecting to an external electrical device; and d) contact means, disposed between the slide and the termination means, for making and breaking electrical connections between the termination means as the slide is moved and for sealing the termination means from harmful environmental effects, the contact means including:

a) a first flexible film having a contact pad and a detent notch;

b) a second flexible film having a plurality of conductor lines and a plurality of conductive vias; and c) an adhesive tape, located between the first and second flexible films, and having a slot formed therein, the contact pad operable to be pressed through the slot by the slide to make and break electrical connections between the conductor lines.

6. The apparatus according to claim 5, wherein the termination means is a solder sphere.

7. The apparatus according to claim 5, wherein the detent notch provides a positive mechanical stop for the switch positions.

8. The apparatus according to claim 5, wherein the termination means is a terminal.

9. The apparatus according to claim 5, wherein the termination means is a solder sphere.

10. A sealed dual in line switch apparatus for selecting a plurality of switch positions, comprising:

a) a housing;

b) a slide disposed within the housing;

c) a row of terminals attached to the housing;

d) a flexible film, located between the terminals and the slide, having a contact pad and a detent notch; and e) an adhesive tape, attached to the flexible film, and having a slot formed therein, the contact pad operable to be pressed through the slot by the slide to electrically connect the terminals.

11. A sealed dual in line switch apparatus for selecting a plurality of switch positions, comprising:

a) a housing;

b) a slide disposed within the housing;

c) a row of terminals attached to the housing;

d) a first flexible film having a contact pad and a detent notch;

e) a second flexible film having a plurality of conductor lines and a plurality of conductive vias; and f) an adhesive tape, located between the first and second flexible films, and having a slot formed therein, the contact pad operable to be pressed through the slot by the slide to make and break electrical connections between the conductor lines.

* * * * *